United States Patent [19]

Adolfsson et al.

[11] 4,370,880

[45] Feb. 1, 1983

[54] METHOD AND APPARATUS FOR BENDING SHEET-PLATE BLANKS TO FORM SHELLS HAVING CYLINDRICAL CURVATURE

[75] Inventors: Rune Adolfsson; Gert A. Persson; Hans A. H. Persson, all of Ystad, Sweden

[73] Assignee: AB Carbox, Ystad, Sweden

[21] Appl. No.: 269,877

[22] Filed: Jun. 3, 1981

[30] Foreign Application Priority Data

Jun. 19, 1980 [SE] Sweden ..... 8004571

[51] Int. Cl.[3] ..... B21D 5/01

[52] U.S. Cl. ..... 72/389; 72/368; 72/403

[58] Field of Search ..... 72/389, 386, 380, 403, 72/404, 412, 379, 368

[56] References Cited

U.S. PATENT DOCUMENTS

| | | | |
|---|---|---|---|
| 1,754,420 | 4/1930 | Fifield . | |
| 4,291,569 | 9/1981 | Breiding | 72/403 |
| 4,294,095 | 10/1981 | Kawano | 72/368 |

FOREIGN PATENT DOCUMENTS

| | | | |
|---|---|---|---|
| 473407 | 3/1929 | Fed. Rep. of Germany | 72/389 |
| 1112490 | 8/1961 | Fed. Rep. of Germany . | |
| 1212024 | 3/1966 | Fed. Rep. of Germany . | |
| 2108787 | 5/1972 | France . | |
| 163769 | 7/1958 | Sweden | 72/389 |
| 428817 | 5/1974 | U.S.S.R. | 72/389 |

*Primary Examiner*—Gene Crosby

*Attorney, Agent, or Firm*—Frishauf, Holtz, Goodman & Woodward

[57] ABSTRACT

An apparatus for bending a substantially planar, plastically deformable sheet-metal blank or plate into a shell of cylindrical curvature comprises two normally provided spaced apart die bars mounted on a die bed plate and a punch edge provided on a punch member, the punch edge being arranged, upon stepwise advancement of the plate, to press said plate down between the two spaced apart die bars. For the purpose of bending respective end parts of the plate, which is effected by so-called eccentric bending, the apparatus includes at least one additional die bar which is located at a greater distance from the end in question of the plate and at a higher level than that one of the two normally provided die bars located furthest from the end of the plate, and functionally replaces the one normally provided die bar. Preferably the apparatus includes a further die bar located outside each of the two normally provided die bars. The invention also relates to a method for bending a sheet-metal blank or plate into a shell of cylindrical curvature.

21 Claims, 3 Drawing Figures

METHOD AND APPARATUS FOR BENDING SHEET-PLATE BLANKS TO FORM SHELLS HAVING CYLINDRICAL CURVATURE

BACKGROUND OF THE INVENTION

The present invention relates to a method of bending a substantially planar, plastically deformable sheet-metal blank or plate to form a shell of cylindrical curvature, and to an apparatus for bending such a blank to a cylindrical curvature.

Long and thick-walled cylindrical vessels, for example steam generators and chemical reactor vessels, are normally manufactured from large, substantially planar sheet-metal blanks. These blanks may have a thickness of from 100–200 mm, a breadth of from 4–5 meters, and a length of 6–12 meters. The blanks are normally shaped in portal presses or four post presses with so-called open tools, i.e. presses in which a punch member is urged down into a die without being brought into contact with a mechanical stop in the final stage of its movement. The die comprises two spaced die bars having a length corresponding to the length of the plate, i.e. 6–12 meters. The punch member is provided with a punch edge having a corresponding length and arranged to penetrate between the die bars. Such an arrangement is shown in FIG. 1.

When shaping the plate, the plate blank is fed stepwise between the punch and the die, and is urged downwardly between the die bars by the punch edge to a predetermined depth determined by the desired shaping radius and the length of the advancing step. The plate can be shaped to a full cylindrical ring having an open slot for the punch, or to a half ring, a so-called half shell. The press forces required for this process are very high, e.g. in order of 5000–20000 tons.

One difficulty encountered in this method of shaping said blanks is that the first part of the blank fed between the punch and the die is not shaped. This also applies to the last part of the plate fed between said die and said punch. The length of these straight parts of the blank can vary, depending upon available press force and plate thickness. A normal value may be 1–3 plate thicknesses. If these straight parts cannot be tolerated in the manufacture of pressure vessels, they must be removed. This is quite usual in normal cases, and results in extra working costs and a large amount of waste.

One method of reducing the length of the straight parts is to use a tool in which the punch edge is displaceable relative to the die bars, so that said punch edge works is closer proximity to the die bar located nearest the end of the plate, as shown in FIG. 2. This known bending method is designated eccentric bending. It gives rise to a number of serious problems, however, namely that the resultant lateral forces are not of equal magnitude, which tends to displace the punch to one side and the die towards the other side. As a result, the press is subjected to much stress and strain, particularly the posts and the guide means.

An object of the present invention is to solve the problem of non-uniform force distribution between the die bars when eccentrically bending a blank in a press of the kind described in the introduction.

SUMMARY OF THE INVENTION

In accordance with the present invention, this is achieved in that said eccentric bending of respective end parts of the plate is effected while using an additional die bar located at a greater distance from the plate-end in question and at a higher level than that one of the two die bars normally provided which is located furthest from the said plate end and functionally replaces the same.

When applying the invention, the two end parts of the sheet-metal blank are suitably first bent while using a respective additional die bar, which is then removed to an inactive position, whereafter the punch edge is centered relative to the two normally provided die bars. Said additional die bars are then suitably swung to one side to said inactive position by means of hydraulic or electric drive means. Centering of the punch edge relative to the two normally provided die bars preferably takes place by displacing the die bed plate carrying the die bars.

DETAILED DESCRIPTION

Figure 1:
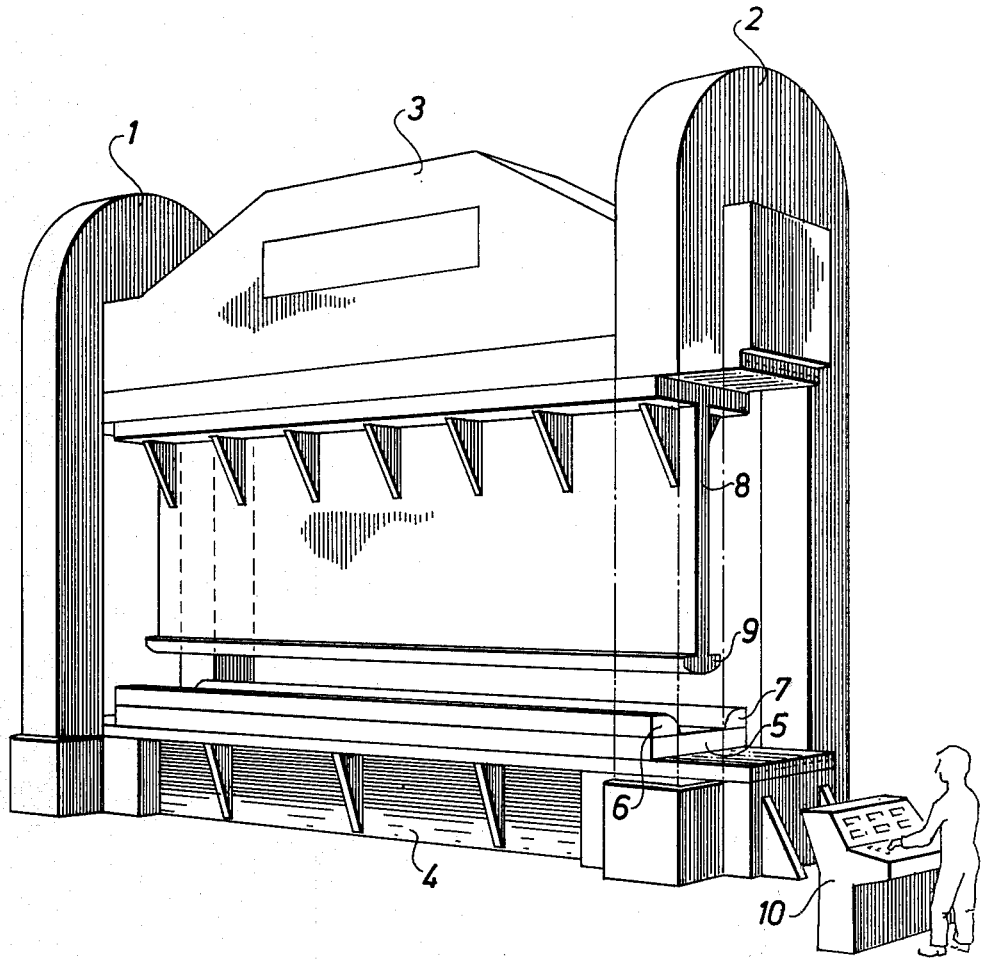
Fig. 1 (PRIOR ART)
FIG. 1 is a perspective view of that part of a prior art plate bending portal press located above the floor.

The portal press (prior art) illustrated in FIG. 1 comprises two wire-wound side frames 1 and 2 and an upper and lower press beam 3 and 4, respectively, arranged therebetween. The lower press beam 4 supports a die bed plate 5 provided with two longitudinally extending, parallel die bars 6 and 7, respectively, arranged in spaced apart relationship. Mounted on the upper beam 3 is a raisable and lowerable punch member 8, which is provided at its lower edge with an elongate punch edge 9 adapted to project down between the die bars 6 and 7. The press is remotely controlled from an operating unit 10.

The prior art press illustrated in FIG. 1 can be used to shape cylindrical shells a metal-sheet blank is fed stepwise between the press tools and bent progressively as a result of the upward and downward movement of the punch edge 9 between the die bars 6 and 7. Thus, as before mentioned, the end parts of the cylinder are not bent.

Figure 2:
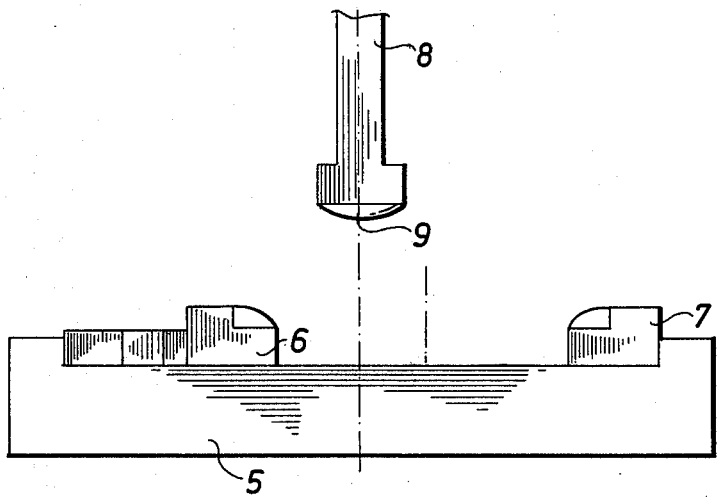
Fig. 2 (PRIOR ART)
FIG. 2 is a schematic sectional view of the press tool of a prior art press illustrated in FIG. 1 for carrying out bending.

For this reason, there are applied today press tools (also prior art) such as those illustrated in FIG. 2 in which one, 6, of the die bars arranged on the die bed plate 5 has been laterally displaced so that the punch 8 provided with the punch edge 9 no longer works centrally between the die bars. This, however, gives rise to an uneven distribution of the forces acting between the die bars 6 and 7 and a non-symmetrical force on the punch 8, which results in relatively high lateral forces which, inter alia, exert relatively high stresses on the guides of the press.

Figure 3:
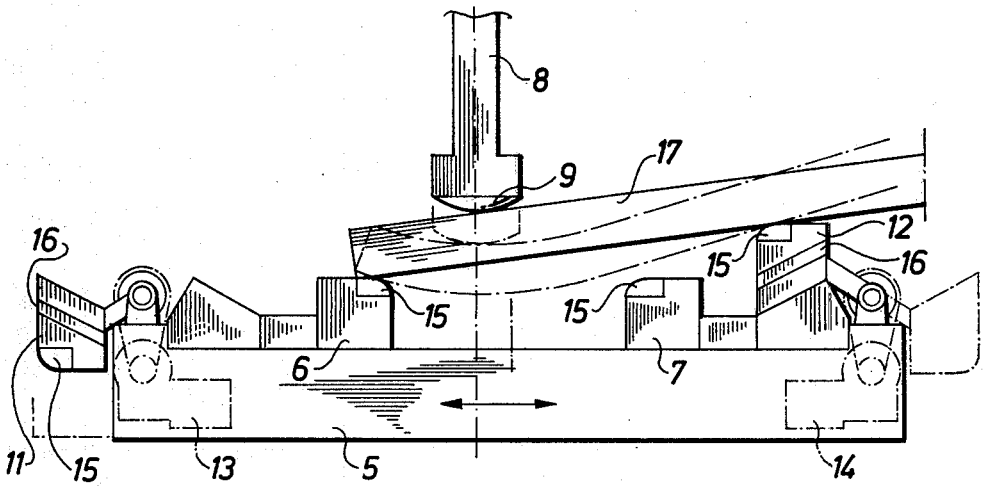
FIG. 3 is a sectional view corresponding to FIG. 2 of a press tool modified in accordance with the invention.

FIG. 3 illustrates an embodiment of a press tool modified in accordance with the invention, in which the die bed plate 5 is displaceable laterally in order to permit both conventional bending of the plate and eccentric bending of said plate. In order to produce a more uniform distribution of forces between the die bars used for eccentric bending of the plate, the tool comprises two additional die bars 11 and 12, respectively, which by means of drive means not shown in detail, for example electrical motors or hydraulic drive 13 and 14, respectively, can be swung between an inactive position, see for example bar 11, to an active position, see for example bar 12. As will be seen from FIGS. 2 and 3, the additional die bars 11, 12 and the two normally provided die bars 6, 7 are provided with linings 15 on those parts which abut the plate where bending shall take place and which are thus subjected to the greatest wear. These linings comprise a high-grade material, such as hardened steel. Although not previously mentioned, the under surfaces of the additional die bars 11 and 12, are, in a preferred embodiment, chamfered. In the embodiment illustrated in FIG. 3 the additional die bars 11 and 12 are arranged to be swung from respective inactive position to the active position, in which active position the lower chamfered surface of said bars abut a correspondingly chamfered support surface, thereby fulfilling the serious stability requirements in a simple fashion. The height of the additional die bars 11, 12 can be adjusted by means of one or more shims or insert plates 16.

The press tool illustrated in FIG. 3 is suitably utilized in a manner such that the two end parts of a sheet-metal blank 17 are first bent by means of respective additional die bars 11 and 12. Thus, referring to FIG. 3, this means that when bending the end sections of the blank the function of the normally provided die bar 6 or 7 located furthest from the end of the plate being bent is carried out by the associated respective additional die bar, which is located at a greater distance from the end of said plate being bent and at a higher level than the normally provided bar which it replaces. In this way it is possible to achieve optimal use of available press force while the resultant of the lateral forces are at a minimum. Subsequent to bending the end parts of the plate to the desired radius, the additional die bars are swung to one side and the die bed plate 5 is displaced so that the punch 8 with punch edge 9 is located centrally above the normally provided die bars 6 and 7, whereafter conventional bending of the cylindrical shell can take place.

As will be understood to those skilled in this art, the sheet-metal blanks are bent or folded while hot. Consequently, it is of extreme importance that the additional die bars are constructed and function in a manner such that their operation is not disturbed by the large amount of scales which may be present, which may amount to several tons when forming large cylinders. Further, because of the extremely high temperatures of the heat radiated by the sheet-metal blank and of safety reasons, it is important that the additional die bars can be remotely operated in a simple and safe manner. This is achieved in accordance with the invention by the illustrated mechanism. The die bars can be brought into operative and inoperative positions by means of gear mechanisms, chains, worm gear motors or the like.

One of normal skill in this art will understand that the invention can be modified in several respects within the scope of the following claims, among other things with respect to the design of the additional die bars and their manner of operation. Provided that the problem basic to the presence of hot scales can be solved, the additional die bars can be arranged for movement in a horizontal or vertical direction, instead of being arranged for swinging movement. The only essential feature of the apparatus is that it comprises additional die bars which can be used for bending the edge parts of a sheet-metal blank in order to use more effectively the accessible press forces without subjecting the press to excessive loads.

What is claimed is:

1. In a method of bending a substantially planar, plastically deformable sheet-metal blank or plate into a shell of cylindrical curvature by stepwise displacement of the plate and downwardly pressing said plate between normally provided first and second spaced apart die bars arranged on a die bed plate by means of a punch edge of a punch member, the punch member being arranged normally to press said plate substantially centrally between said first and second spaced apart die bars, the improvement comprising:

when bending the end parts of the plate, locating an additional die bar at a greater distance from the end in question of said plate and at a higher level than a first one of said first and second normally provided spaced apart die bars which is located furthest from said plate end, said additional die bar functionally replacing said first normally provided die bar; and causing said punch member to press said plate nearer to the second normally provided die bar which is located nearest the plate end in question, so that bending of the respective end parts of the plate is carried out while downwardly pressing said plate with said punch member with the end portion of said plate supported by said second normally provided die bar and a portion of the plate spaced from said end portion supported by said additional die bar.

2. The method of claim 1, comprising first bending an end part of said plate by means of said additional die bar and said second normally provided die bar; and thereafter moving said additional die bar to an inactive position; and centering said punch member carrying said punch edge relative to said first and second normally provided die bars.

3. The method of claim 1 or 2, wherein said step of moving said additional die bar to an inactive position comprises swinging said additional die bar to said inactive position by means of one of hydraulic and electric drive means.

4. The method of claim 2, comprising centering said punch edge relative to said first and second normally provided die bars by displacing the die bed plate carrying said die bars.

5. The method of claim 1, wherein said die bed plate is displaced for centering said punch edge relative to said first and second normally provided die bars.

6. The method of claim 1, further comprising selectively locating a second additional die bar further from the center between said normally provided die bars than said second normally provided die bar and at a higher level than said second normally provided die bar, said second additional die bar selectively functionally replacing said second normally provided die bar, said second additional die bar being provided to bend the end of said plate opposite the end of said plate which is bent by said first mentioned additional die bar and its associated normally provided die bar.

7. The method of claim 6, comprising:

first bending a first end part of said plate by means of said first mentioned additional die bar and second normally provided die bar;

bending the opposite end part of said plate by means of said second additional die bar and said first normally provided die bar; and thereafter moving said additional die bars to respective inactive positions; and centering said punch member carrying said punch edge relative to said first and second normally provided die bars.

8. The method of claim 6 or 7, wherein said step of moving said additional die bars to respective inactive positions comprises swinging said additional die bars to said respective inactive positions by means of one of hydraulic and electric drive means.

9. The method of claim 6, comprising centering said punch edge relative to said first and second normally provided die bars by displacing the die bed plate carrying said die bars.

10. In an apparatus for bending a substantially planar, plastically deformable sheet-metal blank or plate into a shell of cylindrical curvature, comprising a die bed; two spaced apart normally provided die bars arranged on said die bed; and a punch edge provided on a punch member and arranged, in connection with stepwise advancement of the plate to be bent, to press said plate downwardly between said two normally provided die bars, said punch edge normally operating substantially centrally between said normally provided die bars;

the improvement for bending the end parts of the plate being bent, comprising:

at least one additional die bar located at a greater distance from the end in question of the plate to be bent and at a higher level than the one of said two normally provided die bars located furthest from said end of said plate, said at least one additional die bar functionally replacing said one normally provided die bar; and said punch edge being operated nearer to the other of said normally provided die bars which is located nearest the end of said plate being bent for bending said end of said plate.

11. The apparatus of claim 10, comprising a pair of additional die bars located outside of the space between said two normally provided die bars and being on respective opposite sides of said space.

12. The apparatus of claim 11, wherein said additional die bars are each adjustable between an active and a passive position.

13. The apparatus of claim 10, wherein said at least one additional die bar is adjustable between an active and a passive position.

14. The apparatus of any one of claims 10, 11, 12 or 13, further comprising means for swingably mounting said at least one additional die bar for swingable movement between a respective active and passive position.

15. The apparatus of claim 14, wherein said swingable movement means comprises hydraulic drive means.

16. The apparatus of claim 14, wherein said swingable movement means comprises electric drive means.

17. The apparatus of claim 10 or 11, wherein said punch edge and said normally provided die bars are relatively movable to locate said punch edge eccentrically relative to said two normally provided die bars during bending of the edge parts of a plate, and are relatively movable to center said punch edge relative to said two normally provided die bars subsequent to the bending of the edge parts of said plate.

18. The apparatus of claim 17, wherein said relative movement displaces said die bed relative to said punch member so as to move at least said two normally provided die bars relative to said punch edge.

19. The apparatus of claim 10 or 11, wherein said at least one additional die bar is swingably mounted to said die bed.

20. The apparatus of claim 19, wherein said at least one additional die bar has an inclined surface, and said die bed comprises a mating inclined surface which is inclined away from said punch edge, said inclined surface of said at least one additional die bar bearing against said inclined surface of said die bed during bending of said end of said plate.

21. The apparatus of claim 20, further comprising shim means selectively insertable between said inclined surfaces of said at least one additional die bar and said die bed to vary the height of said at least one additional die bar relative to said die bed.

* * * * *